US007607990B1

(12) United States Patent
Slane

(10) Patent No.: US 7,607,990 B1
(45) Date of Patent: Oct. 27, 2009

(54) YIP GRIP SQUEEZE PRESSURE-INDICATING GOLF CLUB GRIP

(76) Inventor: Michael Dominick Slane, 15 Carolina Ave., San Anselmo, CA (US) 94960

( * ) Notice: Subject to any disclaimer, the term of this patent is extended or adjusted under 35 U.S.C. 154(b) by 0 days.

(21) Appl. No.: 12/286,522

(22) Filed: Oct. 1, 2008

(51) Int. Cl.
*A63B 53/14* (2006.01)
*A63B 69/36* (2006.01)

(52) U.S. Cl. ..... 473/300; 473/201; 473/301

(58) Field of Classification Search ..... 473/201, 473/300–303, 520, 521, 523, 550, 568, 549; 81/489; 16/430
See application file for complete search history.

(56) References Cited

U.S. PATENT DOCUMENTS 584,220 A * 6/1897 Gunsaul ..... 74/551.9
4,509,228 A * 4/1985 Landsberger ..... 16/426
5,355,552 A * 10/1994 Huang ..... 16/421
5,846,145 A * 12/1998 Tinlin ..... 473/550
6,821,218 B2 * 11/2004 Byrne et al. ..... 473/568
7,407,444 B2 * 8/2008 Cera ..... 473/300
2002/0142856 A1 * 10/2002 Lindsey ..... 473/300
2005/0043110 A1 * 2/2005 Lindsey ..... 473/300
2006/0009304 A1 * 1/2006 Tremulis et al. ..... 473/300
2006/0205529 A1 * 9/2006 Cera ..... 473/300

* cited by examiner

*Primary Examiner*—Nini Legesse

(57) ABSTRACT

A method is provided for gauging the squeeze pressure of a golf club which generally includes the steps of providing a golf club having an elongated shaft, placing a pneumatically actuated, internally ribbed cushioning device over the distal end of the shaft, the pneumatically actuated, internally ribbed cushioning device having a bladder configured to surround the proximal end of the shaft along a desired length and a finger actuated pump with pressure relief valve for receiving and releasing a volume of air to and from the bladder in order to achieve internal air pressure desired for maximum control of golf strokes. A cushioning and training apparatus is also provided, which includes a ribbed inner layer and an outer layer defining a bladder, and a finger actuated pump with pressure relief valve for receiving and releasing air into and out of the bladder so that it may be pumped up or deflated as desired by the user.

6 Claims, 2 Drawing Sheets

YIP GRIP SQUEEZE PRESSURE-INDICATING GOLF CLUB GRIP

CROSS-REFERENCE TO RELATED APPLICATIONS

Not Applicable

FEDERALLY SPONSORED RESEARCH

Not Applicable

SEQUENCE LISTING OF PROGRAM

Not Applicable

BACKGROUND OF THE INVENTION

1. Field of Invention

This invention generally relates to golf club accessories, specifically golf club grips.

2. Prior Art

Golfers of all skill levels experience increased difficulty putting when mental stress level is high and an affliction known as "the yips" is encountered. Characterized by elevated blood pressure, perspiration, pulse and respiratory rates, the yips are commonly triggered by the psychological stress of sinking an important putt, and often result in the failure to execute an otherwise routine stroke.

For the sake of describing my invention, "the yips" will refer to mental stress induced mistakes of golf swings both on and off the putting green.

During full swings off the putting green, many golfers find themselves swinging too fast or jerky as a result of gripping the club too lightly. Golfers experiencing both the psychological and physiological effects of the yips are often unaware that they are squeezing the club too tightly (or lightly) while swinging, and consequently abandon one of the fundamentals of an accurate golf stroke.

The Yip Grip is an adjustable pneumatic golf club grip that indicates when the appropriate squeeze pressure is applied for a given stroke.

To date, there is no prior art as pertains to golf club grips that addresses the yip-afflicted golfer's need for a means of indicating optimum club squeeze pressure.

There is prior art implementing inflatable grips as a means of cushioning the impacts of striking instruments. Examples include Cera's US Patent Application Publication No. 2006/0205529, Lindsey's US Patent Application Publication No. 2005/0043110, Byrne's U.S. Pat. No. 6,821,218, and Huang's U.S. Pat. No. 5,294,117.

None of these, however, implement the use of a ribbed inner bladder wall, which serves as a means of indicating when desired squeeze pressure has been applied by the user.

Furthermore, Cera's US Patent Application Publication No. 2006/0205529 describes a method for cushioning a pre-existing conventional grip to be applied between a conventional grip and shaft of a striking instrument. My invention is a unique, unconventional, inflatable grip applied directly to a golf club shaft.

While the stated prior art provide means of cushioning impact, none serves as a training aid to assist the user in overcoming the physiological effects of the yips, as described above.

3. Objects and Advantages

Accordingly, several objects and advantages of my invention are:

(a) a mechanism for training golfers to apply appropriate grip squeeze pressures for improved stability of clubs while executing strokes.

(b) as a training aid, adjustable internal grip air pressures are set by the golfer by employing two highly visible and removable finger pump with pressure relief valve units to learn appropriate grip squeeze pressures for all strokes, on and off the putting green.

(c) with the highly visible finger pump with pressure relief valve units removed, my invention functions as a standard golf club grip allowed in competition sanctioned by the United States Golf Association (USGA).

Further objects and advantages will become apparent from consideration of the ensuing description and drawings.

SUMMARY

In accordance with the invention, The Yip Grip comprises a golf club grip with adjustable internal air pressure, enabling the golfer to know when appropriate squeeze pressure is applied to the club, resulting in a steady, more confident, and accurate stroke.

DRAWINGS

Figures

DRAWINGS

Reference Numerals

Figure 1:
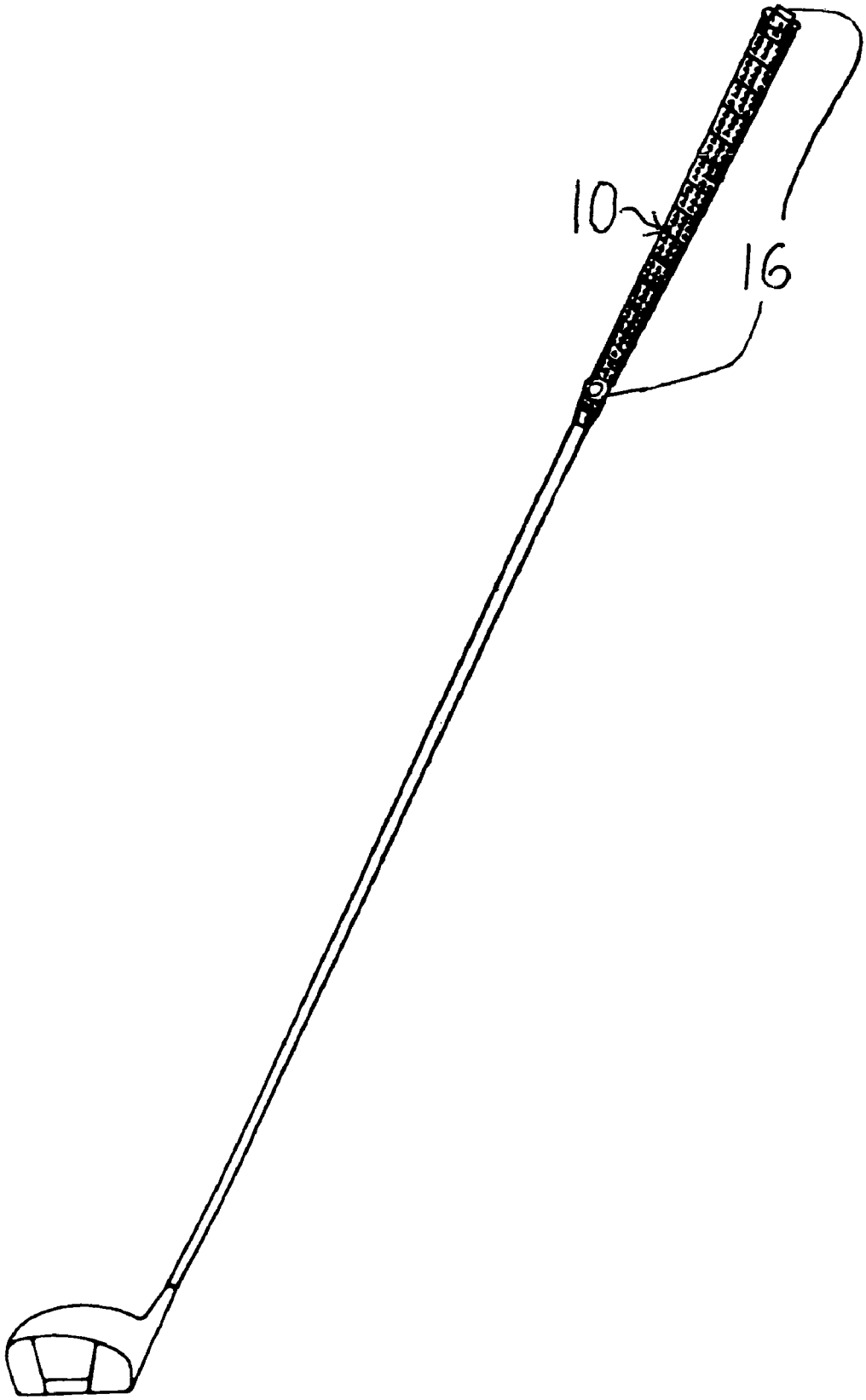
FIG. 1 shows a perspective view of the invention installed on the shaft of a golf club.
Figure 2:
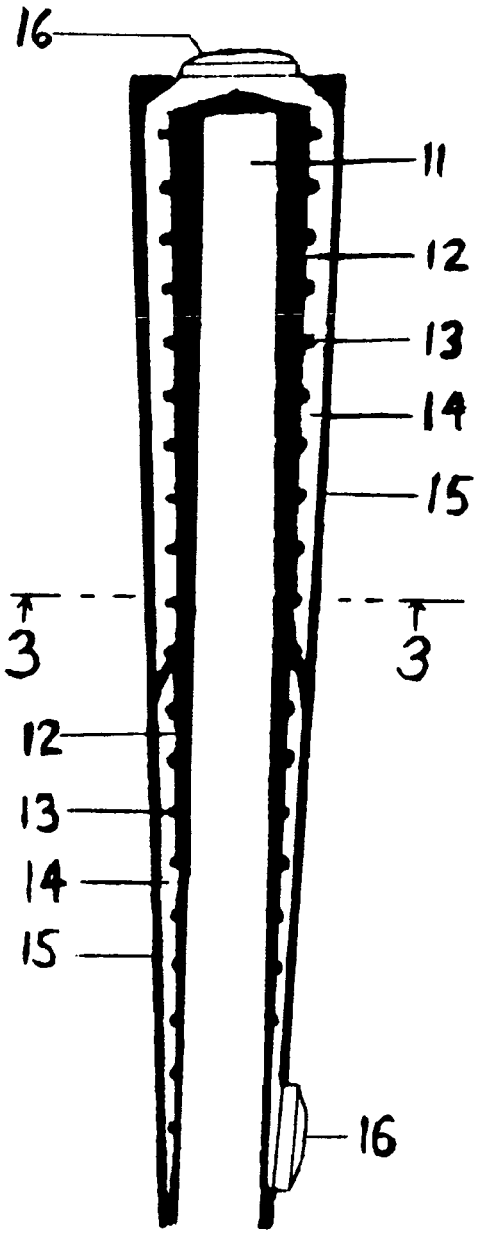
FIG. 2 shows a medial sectional view of the invention.
Figure 3:
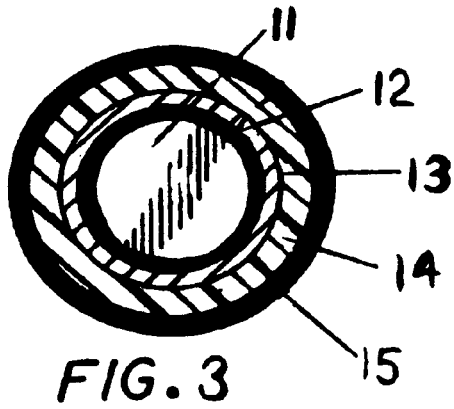
FIG. 3 shows a top sectional view of the invention.

10 present invention
11 hollow core
12 inner wall
13 ringed protrusion of inner wall
14 air filled inner cavity
15 outer wall
16 removable finger pump with pressure relief valve

DETAILED DESCRIPTION

FIGS. 1,2,3

Referring now to the drawings in greater detail, reference number 10 represents the golf club grip of synthetic rubber construction, according to the present invention, whereby a hollow center core 11 is to accommodate the club shaft. From center outward are: 12, the inner wall adorned with 13, $\frac{1}{8}^{th}$ inch circular ringed protrusions every ½ inch, 14, the variable air pressurized inner cavities, 15, the outer wall, and 16, highly visible and removable combination finger pumps with pressure relief valves.

OPERATION

FIGS. 1,2,3,4

In operation, The Yip Grip 10 is mounted on a club shaft with the highly visible and removable combination finger pumps with pressure relief valves 16 open to allow air at atmospheric pressure into the inner cavities 14. The golfer is to close the pressure relief valve and pressurize the inner cavities with the finger pumps to the point where the ringed protrusions 13 of the inner wall 12 can be felt through the outer wall 15 when the appropriate squeeze pressure for a given stroke is applied by both hands.

Being that long putts require a firmer grip than short putts, the golfer determines in a relaxed, stress-free, practice setting how many pumps of 16 produce sufficient air pressure in 12 such that the gripping the club with appropriate firmness will be indicated when the rings 13 of the inner wall are felt. The same holds true for determining the disparity of right and left hand squeeze pressures for shorter putts, and stokes off the putting green.

Once the golfer has been trained to recognize appropriate squeeze pressures required for all strokes, the highly visible finger pump with pressure relief valve units can be removed and, because training aids are no longer attached, the grip can be used in competition sanctioned by the United States Golf Association (USGA).

The invention claimed is:

1. A method of training a golfer to apply appropriate grip squeeze pressure comprising the steps of: providing a golf club having an elongated shaft, the elongated shaft having a proximal end to be grasped by a user; placing a grip consisting of a pneumatically actuated cushioning and training apparatus over the proximal end of the shaft, the pneumatically actuated cushioning and training apparatus comprising a bladder configured to surround the proximal end of the shaft along a desired length, and a finger actuated pump and pressure relief valve for receiving and releasing a volume of air and operating the pump in order to inject a specific volume of air into the bladder, thereby providing the desired internal air pressure to cushion the grip and train the golfer to apply optimum squeeze pressure for maximum control of a stroke; wherein the cushioning apparatus further comprises an elongated inner wall comprising ringed protrusions and elongated outer wall having an upper and lower ends; wherein the lower end of the inner wall and the lower end of the outer wall are sealed such that the bladder is defined between the inner wall and the outer wall; and wherein the ringed protrusions of the inner wall are felt by the golfer through the outer layer when the bladder is optimally pressurized for a given stroke.

2. The method of claim 1, wherein the inner wall and the outer wall each defines a thin skin.

3. The method of claim 1, further comprising the steps of: removing a conventional golf club grip from the shaft of the golf club and replacing with a grip consisting of a pneumatically actuated cushioning and training apparatus.

4. The method of claim 1, wherein the outer wall defines a golf grip to be engaged by the hands of a golfer.

5. The apparatus of claim 1, wherein golf club has a butt, wherein the finger actuated pump with pressure relief valve is aligned with the through-opening in the butt.

6. An improved golf club, comprising: an elongated shaft having a distal end and a proximal end, the proximal end to be grasped by a user; a head at the distal end of the shaft; a butt at the end of the proximal end of the shaft, the butt having a through-opening; and a pneumatically actuated cushioning and training apparatus placed over the proximal end of the shaft, the pneumatically actuated cushioning and training apparatus comprising a single elongated bladder configured to surround the proximal end of the shaft along a desired length, a finger actuated pump with pressure relief valve for receiving and releasing a volume of air, the finger actuated pump with pressure relief valve being aligned with the through-opening in the butt; and wherein the cushioning apparatus further comprises an elongated inner wall comprising ringed protrusions and elongated outer wall having an upper and lower ends; wherein the lower end of the inner wall and the lower end of the outer wall are sealed such that the bladder is defined between the inner wall and the outer wall; and wherein the ringed protrusions of the inner wall are felt by the golfer through the outer layer when the bladder is optimally pressurized for a given stroke.

* * * * *